US007473351B2

(12) United States Patent
Burnett et al.

(10) Patent No.: US 7,473,351 B2
(45) Date of Patent: Jan. 6, 2009

(54) REMOVAL OF NITROGEN, SULFUR, AND ALKYLATING AGENTS FROM HYDROCARBON STREAMS

(75) Inventors: Ptoshia Avon Burnett, Landenberg, PA (US); Michael Graham Hodges, Surrey (GB); Thomas Knox, Berkshire (GB)

(73) Assignee: BP Corporation North America Inc., Warrenville, IL (US)

( * ) Notice: Subject to any disclaimer, the term of this patent is extended or adjusted under 35 U.S.C. 154(b) by 0 days.

(21) Appl. No.: 10/509,832

(22) PCT Filed: Apr. 16, 2003

(86) PCT No.: PCT/GB03/01637

§ 371 (c)(1),
(2), (4) Date: Oct. 3, 2005

(87) PCT Pub. No.: WO03/089543

PCT Pub. Date: Oct. 30, 2003

(65) Prior Publication Data

US 2006/0081502 A1 Apr. 20, 2006

(51) Int. Cl.
*C10G 17/00* (2006.01)

(52) U.S. Cl. ..... 208/254 R; 208/208 R; 208/211; 208/220; 208/232; 208/237; 208/238; 208/245

(58) Field of Classification Search ..... 208/208 R, 208/254 R, 211, 220, 232, 237, 238, 245
See application file for complete search history.

(56) References Cited

U.S. PATENT DOCUMENTS 4,410,421 A 10/1983 Atherton et al.
4,529,504 A 7/1985 Poirier et al.
4,816,138 A 3/1989 Visser et al.
4,973,790 A 11/1990 Beech, Jr. et al.
5,053,579 A 10/1991 Beech, Jr. et al.

(Continued)

FOREIGN PATENT DOCUMENTS

CA 1209927 8/1986

(Continued)

OTHER PUBLICATIONS

Irvine, et al; "NPRA Annual Meeting" (San Antonio Mar. 1999) (Adaptation) *Petroleum Technology Quarterly*; V4 N.2 37-40, 42, 44 (Summer 1999) ISSN: 1362-363.

(Continued)

*Primary Examiner*—Glenn Caldarola
*Assistant Examiner*—Prem C. Singh
(74) *Attorney, Agent, or Firm*—Nixon & Vanderhye

(57) ABSTRACT

The present invention provides a process for reducing the nitrogen content of a liquid hydrocarbon feed wherein said process comprises a) contacting a liquid hydrocarbon feed comprising an alkylating agent and organic nitrogen species with an acidic catalyst at elevated temperature in a first reaction zone to generate a liquid hydrocarbon feed comprising a reduced alkylating agent content and organic nitrogen species of higher boiling point. b) fractionating the liquid hydrocarbon feed comprising a reduced alkylating agent content and organic nitrogen species of higher boiling point to remove the organic nitrogen species of higher boiling point to generate a liquid hydrocarbon feed comprising a reduced alkylating agent content and a reduced nitrogen content.

16 Claims, 3 Drawing Sheets

U.S. PATENT DOCUMENTS

Figure 1:
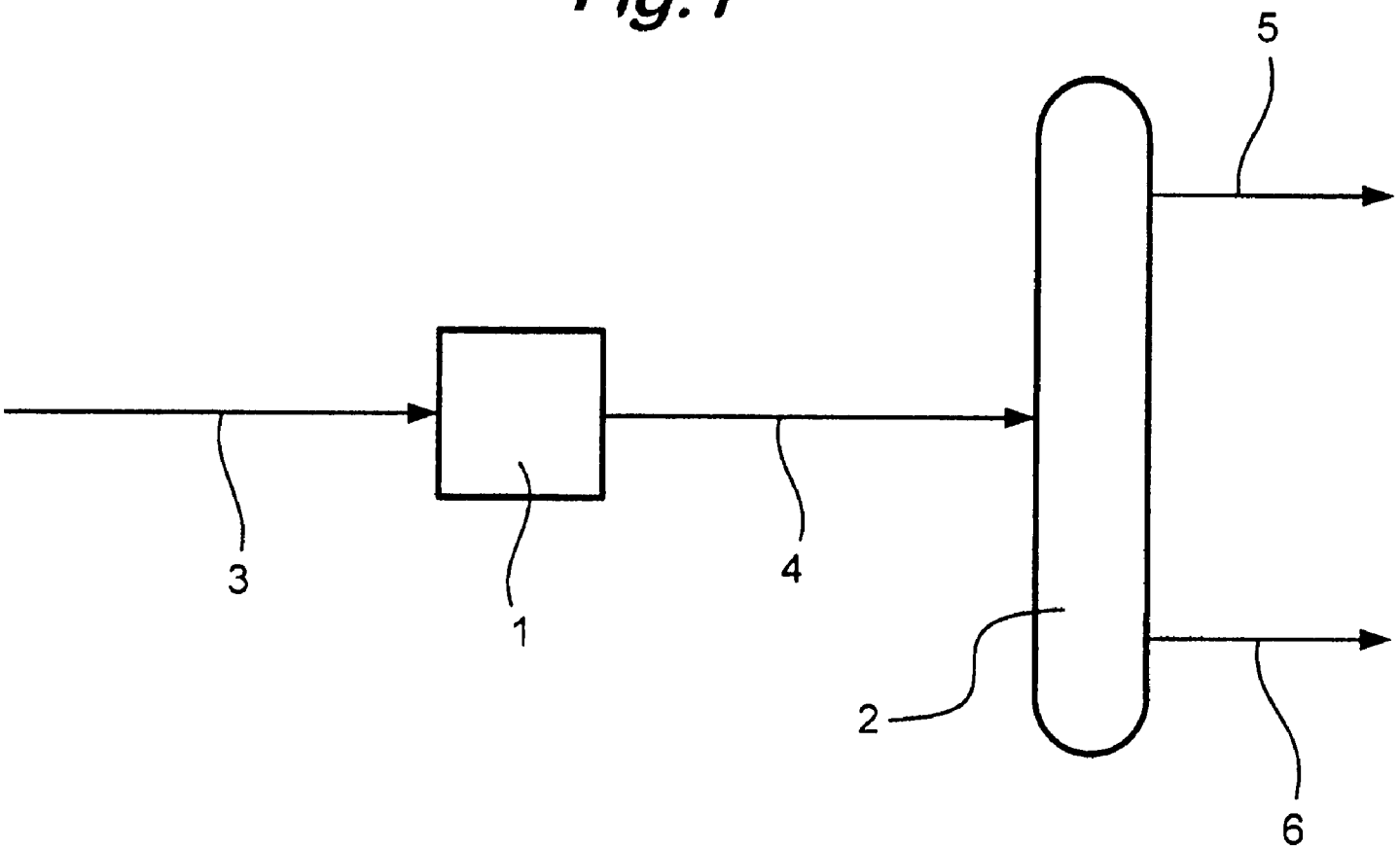

| | | | | |
|---|---|---|---|---|
| 5,109,139 | A | 4/1992 | Dickson et al. | |
| 5,171,916 | A | 12/1992 | Le et al. | |
| 5,220,099 | A | 6/1993 | Schreiner et al. | |
| 5,599,441 | A * | 2/1997 | Collins et al. | 208/208 R |
| 5,744,686 | A | 4/1998 | Gajda | |
| 5,942,650 | A | 8/1999 | Gajda | |
| 6,019,887 | A | 2/2000 | Ramirez de Agudelo et al. | |
| 6,024,865 | A | 2/2000 | Alexander et al. | |
| 6,048,451 | A | 4/2000 | Huff, Jr. et al. | |
| 6,059,962 | A | 5/2000 | Alexander et al. | |
| 6,107,535 | A | 8/2000 | Rossini et al. | |
| 6,118,037 | A | 9/2000 | Piccoli et al. | |
| 2003/0149324 | A1 | 8/2003 | Venkat et al. | |
| 2004/0118748 | A1 | 6/2004 | Lesemann et al. | |
| 2005/0143612 | A1 | 6/2005 | Hwang et al. | |

FOREIGN PATENT DOCUMENTS

| | | |
|---|---|---|
| CN | A-1338450 A | 3/2002 |
| GB | 1334226 | 10/1973 |
| WO | WO 01/53432 A1 | 7/2001 |
| WO | WO 01/53433 | 7/2001 |

OTHER PUBLICATIONS

Jean et al; "192nd ACS National Meeting (Anaheim 9/7-12/86)"; *ACS Div. Fuel Chem. Prepr.*; V31 N. 3 262-65 (1986).

Jean et al; "190th ACS National Meeting (Chicago 9/18-13/85)"; *ACS Div. Fuel Chem. Prepr.*; V30 N. 4 474-80 (1985).

Rayner-Canham et al; Fuel, V63 N. 10 1472-74 (Oct. 1984); ISSN: 0016-2361.

* cited by examiner

REMOVAL OF NITROGEN, SULFUR, AND ALKYLATING AGENTS FROM HYDROCARBON STREAMS

This application is the U.S. National Phase of International Application PCT/GB03/01637, filed 16 Apr. 2003, which designated the U.S.

This invention relates to a purification process, in particular one to remove nitrogen compounds from hydrocarbon feeds.

It is desirable to remove nitrogen compounds from hydrocarbon feeds for environmental reasons. Furthermore hydrocarbon feeds are often further processed to provide upgraded products. This further processing may include catalytic reforming, catalytic hydrotreating, catalytic desulphurisation and adsorption. Such catalysts and adsorbents are usually deactivated by presence of nitrogen compounds and consequently it is desirable to remove the nitrogen compounds from hydrocarbon feeds prior to upgrading to avoid deactivation of the catalyst or adsorbent.

Accordingly the present invention provides a process for increasing the boiling point of organic nitrogen species present within a liquid hydrocarbon feed wherein said process comprises contacting a liquid hydrocarbon feed comprising organic nitrogen species with an acidic catalyst at elevated temperature in a first reaction zone to generate a liquid hydrocarbon feed comprising organic nitrogen species of higher boiling point.

The organic nitrogen species of higher boiling point may be generated by condensation reactions between the organic nitrogen species or may be generated by the reaction of the organic nitrogen species with aromatic species present within the liquid hydrocarbon feed.

Preferably the organic nitrogen species of higher boiling point are generated by reacting the organic nitrogen species with an alkylating agent.

Accordingly the present invention also provides a process for increasing the boiling point of organic nitrogen species present within a liquid hydrocarbon feed wherein said process comprises contacting a liquid hydrocarbon feed comprising an alkylating agent and organic nitrogen species with an acidic catalyst at elevated temperature in a first reaction zone to generate a liquid hydrocarbon feed comprising a reduced alkylating agent content and organic nitrogen species of higher boiling point.

The present invention also provides a process for reducing the nitrogen content of a liquid hydrocarbon feed wherein said process comprises a) contacting a liquid hydrocarbon feed comprising organic nitrogen species with an acidic catalyst at elevated temperature in a first reaction zone to generate a liquid hydrocarbon feed comprising organic nitrogen species of higher boiling point b) removing the organic nitrogen species of higher boiling point to generate a liquid hydrocarbon feed comprising a reduced nitrogen content.

Wherein the liquid hydrocarbon feed comprises an alkylating agent and organic nitrogen species the present invention provides a process for reducing the nitrogen content of the liquid hydrocarbon feed wherein said process comprises a) contacting the liquid hydrocarbon feed comprising an alkylating agent and organic nitrogen species with an acidic catalyst at elevated temperature in a first reaction zone to generate a liquid hydrocarbon feed comprising a reduced alkylating agent content and organic nitrogen species of higher boiling point b) removing the organic nitrogen species of higher boiling point to generate a liquid hydrocarbon feed comprising a reduced alkylating agent content and a reduced nitrogen content.

The organic nitrogen species of higher boiling point may be removed using a nitrogen trap which may comprise a nitrogen adsorbent or a molecular sieve. Preferably the organic nitrogen species of higher boiling point is removed by fractionation.

Accordingly a preferred embodiment of the present invention provides a process for reducing the nitrogen content of a liquid hydrocarbon feed wherein said process comprises a) contacting a liquid hydrocarbon feed comprising an alkylating agent and organic nitrogen species with an acidic catalyst at elevated temperature in a first reaction zone to generate a liquid hydrocarbon feed comprising a reduced alkylating agent content and organic nitrogen species of higher boiling point b) fractionating the liquid hydrocarbon feed comprising a reduced alkylating agent content and organic nitrogen species of higher boiling point to remove the organic nitrogen species of higher boiling point to generate a liquid hydrocarbon feed comprising a reduced alkylating agent content and a reduced nitrogen content.

The processes of the present invention may also be used in combination with a process to remove sulphur. Legislation in many parts of the world for hydrocarbon fuels, such as gasoline and middle distillates e.g. diesel and gasoline requires upper limits on the content of sulphur compounds in the fuel for environmental reasons. There is a continual requirement to improve desulphurisation processes to produce hydrocarbon fuels with lower sulphur content.

Accordingly the present invention also provides a process for reducing the sulphur and nitrogen content of a liquid hydrocarbon feed wherein said process comprises a) contacting a liquid hydrocarbon feed comprising an alkylating agent and organic nitrogen and organic sulphur species with an acidic catalyst at elevated temperature in a first reaction zone to generate a liquid hydrocarbon feed comprising a reduced alkylating agent content, organic sulphur species and organic nitrogen species of higher boiling point b) contacting the liquid hydrocarbon feed comprising a reduced alkylating agent content, organic sulphur species and organic nitrogen species of higher boiling point with an acidic catalyst at elevated temperature in a second reaction zone to generate a liquid hydrocarbon feed comprising a reduced alkylating agent content, organic sulphur species of higher boiling point and organic nitrogen species of higher boiling point c) fractionating the liquid hydrocarbon feed comprising a reduced alkylating agent content, organic sulphur species of higher boiling point and organic nitrogen species of higher boiling point to remove the organic nitrogen species of higher boiling point and the organic sulphur species of higher boiling point to generate a liquid hydrocarbon feed comprising a reduced alkylating agent content and a reduced nitrogen and sulphur content.

Alternatively the liquid hydrocarbon feed comprising a reduced alkylating agent content, organic sulphur species and organic nitrogen species of higher boiling point generated in step (a) may be fractionated prior to contact with the acidic catalyst in the second reaction zone.

Accordingly the present invention further provides a process for reducing the sulphur and nitrogen content of a liquid hydrocarbon feed wherein said process comprises a) contacting a liquid hydrocarbon feed comprising an alkylating agent and organic nitrogen and sulphur species with an acidic catalyst at elevated temperature in a first reaction zone to generate a liquid hydrocarbon feed comprising a reduced alkylating agent content, organic sulphur species and organic nitrogen species of higher boiling point b) fractionating the liquid hydrocarbon feed comprising a reduced alkylating agent content, organic sulphur species and organic nitrogen species of higher boiling point to remove the organic nitrogen species of higher boiling point to generate a liquid hydrocarbon feed comprising a reduced alkylating agent content, organic sulphur species and a reduced nitrogen content.

c) contacting the liquid hydrocarbon feed comprising a reduced alkylating agent content, organic sulphur species and a reduced nitrogen content with an acidic catalyst at elevated temperature in a second reaction zone to generate a liquid hydrocarbon feed comprising a reduced alkylating agent content, organic sulphur species of higher boiling point and reduced nitrogen content d) fractionating the liquid hydrocarbon feed comprising a reduced alkylating agent content, organic sulphur species of higher boiling point and a reduced nitrogen content to remove the organic sulphur species of higher boiling point to generate a liquid hydrocarbon feed comprising a reduced alkylating agent content and a reduced nitrogen and sulphur content.

The liquid hydrocarbon feed is usually a liquid at a temperature of 25° C. and at a pressure of 1 barg and is generally directly or indirectly derived from a crude oil distillation. The liquid hydrocarbon feed usually contains saturated hydrocarbons e.g. branched and unbranched alkanes and alicyclic hydrocarbons as well as variable amounts of aromatics and/or unsaturated compounds such as olefins.

The liquid hydrocarbon feed may be a light or middle distillate which may be one or more petroleum fractions with a boiling range of 10-450° C., preferably 190-390° C. Advantageously the middle distillate stream is a combination of said petroleum fractions. Examples of suitable petroleum fractions include catalytically cracked naphtha (CCN), coker naphtha (CN), visbrocked naphtha (VBN), light gas oils (LGO), heavy gas oils (HGO), light cycle oils (LCO), coker gas oils (CGO) and Visbroken gas oils (VBGO). Preferably the liquid hydrocarbon feed is diesel, gasoline, kerosene or jet fuel and is advantageously diesel or jet fuel.

The liquid hydrocarbon feed comprises organic nitrogen species. The organic nitrogen species usually comprise alkyl amines, anilines, pyroles and pryridines. The liquid hydrocarbon feed comprising organic nitrogen species usually has a total nitrogen content (expressed as elemental N) of 5-3000 ppm N, preferably 10-500 ppm N e.g. 100 ppm N. When the liquid hydrocarbon comprising organic nitrogen species is diesel the diesel may contain contaminant sulphur in the range of 10-100 ppm (expressed as elemental N). The nitrogen compounds usually have a boiling point of between 50 and 450° C.

When the process of the present invention is used in combination with a process to remove sulphur the liquid hydrocarbon feed usually comprises organic sulphur species.

The organic sulphur species usually comprise mercaptans, thiophenes and benzothiophenes (BT's) e.g. dibenzothiophenenes (DBT's) and hindered alkyl substituted dibenzothiophenes (hindered DBT's). Usually the liquid hydrocarbon feed comprising an alkylating agent and organic nitrogen and sulphur species usually has a total sulphur content (expressed as elemental S) of 10-50000 ppm S, preferably 50-20000 ppm S e.g. 500 ppm S.

The liquid hydrocarbon feed may further comprise an alkylating agent.

The alkylating agent may be an alcohol and/or an olefin and is usually present in the liquid hydrocarbon feed comprising an organic nitrogen species. Alternatively the alkylating agent may be added to the liquid hydrocarbon feed comprising an organic nitrogen species prior to contact with the acidic catalyst.

The alkylating agent is usually an olefin and suitable olefins include cyclic olefins, substituted cyclic olefins, and olefins of formula I wherein $R_1$ is a hydrocarbyl group and each $R_2$ is independently selected from the group consisting of hydrogen and hydrocarbyl groups. Preferably, $R_1$ is an alkyl group and each of $R_2$ is independently selected from the group consisting of hydrogen and alkyl groups. Examples of suitable cyclic

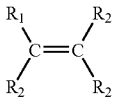

olefins and substituted cyclic olefins include cyclopentene, 1-methylcyclopentene, cyclohexene, 1-methylcyclohexene, 3-methylcyclohexene, 4-methylcyclohexene, cycloheptene, cyclooctene, and 4-methylcyclooctene. Examples of suitable olefins and of the type of formula I include propene, 2-methylpropene, 1-butene, 2-butene, 2-methyl-1-butene, 3-methyl-1-butene, 2-methyl-2-butene, 2,3-dimethyl-1-butene, 3,3-dimethyl-1-butene, 2,3-dimethyl-2-butene, 2-ethyl-1-butene, 2-ethyl-3-methyl-1-butene, 2,3,3-trimethyl-1-butene, 1-pentene, 2-pentene, 2-methyl-1-pentene, 3-methyl-1-pentene, 3-methyl-1-pentene, 2,4-dimethyl-1-pentene, 1-hexene, 2-hexene, 3-hexene, 1,3-hexadiene, 1,4-hexadiene, 1,5-hexadiene, 2,4-hexadiene, 1-heptene, 2-heptene, 3-heptene, 1-octene, 2-octene, 3-octene, and 4-octene. Secondary and tertiary alcohols are preferred over primary alcohols because they are usually more reactive than the primary alcohols and can be used under milder reaction conditions.

Preferred alkylating agents will contain between 3-20 carbon atoms, advantageously between 5-10 carbon atoms. The optimal number of carbon atoms in the alkylating agent will usually be determined by the increase in boiling point that is required.

The liquid hydrocarbon feed usually contains at least 1% by weight of alkylating agent, preferably at least 3% by weight of alkylating agent and most preferably at least 5% by weight of alkylating agent.

When the liquid hydrocarbon feed comprises an alkylating agent and organic nitrogen species it is contacted with an acidic catalyst at elevated temperature in a first reaction zone to produce a liquid hydrocarbon feed comprising a reduced alkylating agent content and organic nitrogen species of higher boiling point.

Any suitable acidic catalyst may be used that is capable of promoting the alkylation of the organic nitrogen species by olefins or alcohols in the first reaction zone. The acidic catalyst may be a liquid e.g. sulphuric acid but preferably the acidic catalyst is a solid.

Solid acidic materials may comprise acidic polymeric resins, supported acids, and acidic inorganic oxides. Suitable acidic polymeric resins include the polymeric sulphonic acid resins. Supported acids are usually Brönsted acids e.g. phosphoric acid, sulphuric acid, boric acid, hydrogen fluoride, fluorosulphonic acid, trifluoro-methanesulphonic acid, and dihydroxyfluoroboric acid but may also be Lewis acids e.g. $BF_3$, $BCl_3$, $AlCl_3$, $AlBr_3$, $FeCl_2$, $FeCl_3$, $ZnCl_2$, $SbF_5$, $SbCl_5$ and combinations of $AlCl_3$ and HCl which are supported on solids such as silica, alumina, silica-aluminas, zirconium oxide or clays.

The acidic inorganic oxides also include aluminas, silica-aluminas, natural and synthetic pillared clays, and natural and synthetic zeolites such as faujasites, mordenites, L, omega, X, Y, beta, and ZSM zeolites. Highly suitable zeolites include beta, Y, ZSM-3, ZSM-4, ZSM-5, ZSM-18, and ZSM-20. Desirably, the zeolites are incorporated into an inorganic oxide matrix material such as a silica-alumina.

The acidic catalyst may comprise mixtures of different materials, such as a Lewis acid e.g. $BF_3$, $BCl_3$, $SbF_5$, and $AlCl_3$, a non-zeolitic solid inorganic oxide e.g. silica, alumina and silica-alumina, and a large-pore crystalline molecular sieve e.g. zeolites, pillared clays and aluminophosphates.

Preferably the acidic catalyst is at least partly deactivated with respect to generating organic sulphur compounds of higher boiling point and advantageously the acidic catalyst used in the first reaction zone has advantageously previously been used in the second reaction zone as herein described below.

The liquid hydrocarbon feed comprising an alkylating agent and organic nitrogen species is preferably contacted with the acidic catalyst in the first reaction zone at a temperature of between 50° C.-300° C., preferably between 100-200° C. e.g. 150° C. and at pressure of between 1-100 bar, preferably between 10-40 bar e.g. 25 bar.

The first reaction zone usually comprises a fixed bed of catalyst.

The first reaction zone generates a liquid hydrocarbon feed comprising a reduced alkylating agent content and organic nitrogen species of higher boiling point. The content of the alkylating agent in the liquid hydrocarbon feed is reduced as it reacts with the organic nitrogen species to produce alkylated organic nitrogen species usually having a boiling point of greater than 200° C. Usually the boiling point of the organic nitrogen species is shifted upwards by at least 50° C., preferably by at least 100° C. and advantageously by at least 150° C.

Usually at least 50% by weight of the organic nitrogen species present in the hydrocarbon feed are alkylated, preferably at least 60% by weight are alkylated and advantageously at least 70% by weight are alkylated.

The first reaction zone generates a liquid hydrocarbon feed comprising a reduced alkylating agent content and organic nitrogen species of higher boiling point and this is advantageously passed to a first fractionating unit to generate a liquid hydrocarbon feed comprising a reduced alkylating agent content and a reduced nitrogen content.

The fractionation usually generates at least two hydrocarbon feed streams wherein one hydrocarbon feed stream comprises a higher boiling range and an increased nitrogen content and wherein one hydrocarbon feed stream comprises a lower boiling range and and a reduced nitrogen content.

The fractionation is usually carried out by distillation to separate hydrocarbons and nitrogen species with a higher boiling point and these are typically removed at temperatures above 150° C., preferably above 180° C.

The first fractionating unit may be a purpose built distillation column e.g. a fractional distillation column, but is preferably conducted in an existing crude distillation unit (CDU) or fluid cracking catalyst (FCC) main fractionator.

Advantageously the first reaction zone may be located within the first fractionating unit.

The process of the present invention provides a liquid hydrocarbon feed with a boiling range of between 10-450° C., e.g. 10-200° C. or 200-350° C. comprising a nitrogen content of less than 50 ppmN e.g. 20-40 ppmN, preferably less than 10 ppmN e.g. 5-10 ppmN, and advantageously less than 5 ppmN e.g. 2-4 ppmN or less than 1 ppmN e.g. 0.01-0.5 ppm (expressed by weight as elemental N).

When the liquid hydrocarbon feed comprises an alkylating agent and organic nitrogen and organic sulphur species the liquid hydrocarbon feed may be contacted with an acidic catalyst at elevated temperature in a first reaction zone as herein described above to generate a liquid hydrocarbon feed comprising a reduced alkylating agent content, organic sulphur species and organic nitrogen species of higher boiling point. This resultant hydrocarbon feed may then be contacted with an acidic catalyst in a second reaction zone to generate a liquid hydrocarbon feed comprising a reduced alkylating agent content, organic sulphur species of higher boiling point and organic nitrogen species of higher boiling point.

The second reaction zone is usually at a temperature of between 100° C.-300° C., preferably between 160-220° C. e.g. 190° C., and at pressure of between 1-100 bar, preferably between 10-60 bar e.g. 20-40 bar and usually comprises a fixed bed of acidic catalyst.

The acidic catalyst in the second reaction zone may be an acidic catalyst as herein described above.

The second reaction zone generates a liquid hydrocarbon feed comprising a further reduced alkylating agent content, organic nitrogen species of higher boiling point and organic sulpher species of higher boiling point. The content of the alkylating agent in the liquid hydrocarbon feed is further reduced as it reacts with the organic sulphur species to produce alklated organic sulphur species usually having a boiling point of between 100-250° C.

Usually the boiling point of the organic sulphur species is shifted upwards by at least 50° C., preferably by at least 100° C. and advantageously by at least 150° C.

Usually at least 50% by weight of the organic sulphur species present in the liquid hydrocarbon feed are alkylated, preferably at least 60% by weight are alkylated and advantageously at least 70% by weight are alkylated.

The first and second reaction zones generate a liquid hydrocarbon feed comprising a reduced alkylating agent content, organic sulphur species of higher boiling point and organic nitrogen species of higher boiling point and this is advantageously passed to the fractionating unit to remove the organic nitrogen species of higher boiling point and the organic sulphur species of higher boiling point to generate a liquid hydrocarbon feed comprising a reduced alkylating agent content and a reduced nitrogen and sulphur content.

The fractionation usually generates at least two hydrocarbon feed streams wherein one hydrocarbon feed stream comprises a higher boiling range and an increased nitrogen and sulphur content and wherein one hydrocarbon feed stream comprises a lower boiling range and a reduced nitrogen and sulphur content.

The fractionation is usually carried out by distillation as herein described above to separate hydrocarbons, nitrogen and sulphur species with a higher boiling point and these are typically removed at temperatures above 150° C., preferably above 180° C.

Advantageously the first and second reaction zones may be located in the first fractionating unit.

Alternatively the liquid hydrocarbon feed comprising a reduced alkylating agent content, organic sulphur species and organic nitrogen species of higher boiling point may be fractionated in a first fractionating unit prior to contact with the acidic catalyst in the second reaction zone. The fractionation (as herein described above) usually generates at least two hydrocarbon feed streams wherein one hydrocarbon feed stream comprises a higher boiling range and an increased nitrogen content and wherein one hydrocarbon feed stream comprises a lower boiling range and a reduced nitrogen content. The hydrocarbon feed stream comprising a lower boiling range and a reduced nitrogen content (which also contains an alkylating agent and organic sulphur species) is then passed to the second reaction zone which generates a liquid hydrocarbon feed comprising organic sulphur species of higher boiling point which is then removed by a second fractionating unit.

Advantageously the second reaction zone may be located in the second fractionating unit.

The process of the present invention further provides a liquid hydrocarbon feed with a boiling range of between 10-450° C., e.g 10-200° C. or 200-350° C. comprising a nitrogen content of less than 50 ppmN e.g. 20-40 ppmN, preferably less than 10 ppmN e.g. 5-10 ppmN, and advantageously less than 5 ppmN e.g. 2-4 ppmN or less than 1 ppmN e.g. 0.01-0.5 ppmN (expressed by weight as elemental N) and a sulphur content of less than 500 ppmS e.g. 200-400 ppmS, preferably less than 200 ppmS e.g. 50-100 ppmS, and advantageously less than 50 ppmS e.g. 2040 ppmS or less than 10 ppmS e.g. 0.1-5 ppm (expressed by weight as elemental S).

The processes of the present invention may advantageously provide the feedstock for any processing step that is sensitive to the presence of nitrogen and optionally sulphur. In particular the processes of the present invention may advantageously provide the feedstock for catalytic reforming, catalytic hydrotreating and catalytic hydrodesulphurisation processes.

Advantageously the process for reducing the nitrogen content of a liquid hydrocarbon feed as herein described above may advantageously provide the feedstock for the sulphur removal processes described in U.S. Pat. No. 6,024,865, U.S. Pat. No. 6,048,451, U.S. Pat. No. 6,059,962, WO 01/53432A1 and WO 01/53433 the disclosures of which are herein incorporated by reference.

The process may advantageously be used to remove nitrogen species prior to a sulphur adsorption process to prevent the nitrogen species from adsorbing onto the adsorbent in preference to the sulphur species.

The invention will now be described with reference to the following figures.

FIG. 1 shows a first reaction zone (1) and a fractionating unit (2). A liquid hydrocarbon feed comprising an alkylating agent and organic nitrogen species is passed to the first reaction zone (1) via line (3) wherein it is contacted with an acidic catalyst and the organic nitrogen species are alkylated to form organic nitrogen species of higher boiling point.

The liquid hydrocarbon feed is then passed via line (4) to the fractionating unit (2) wherein it is separated to provide a hydrocarbon feed stream with a lower boiling range and a decreased nitrogen content which exits the fractionating unit (2) via line (5) and a hydrocarbon feed stream with a higher boiling range and an increased nitrogen content which exits the fractionating unit (2) via line (6).

Figure 2:
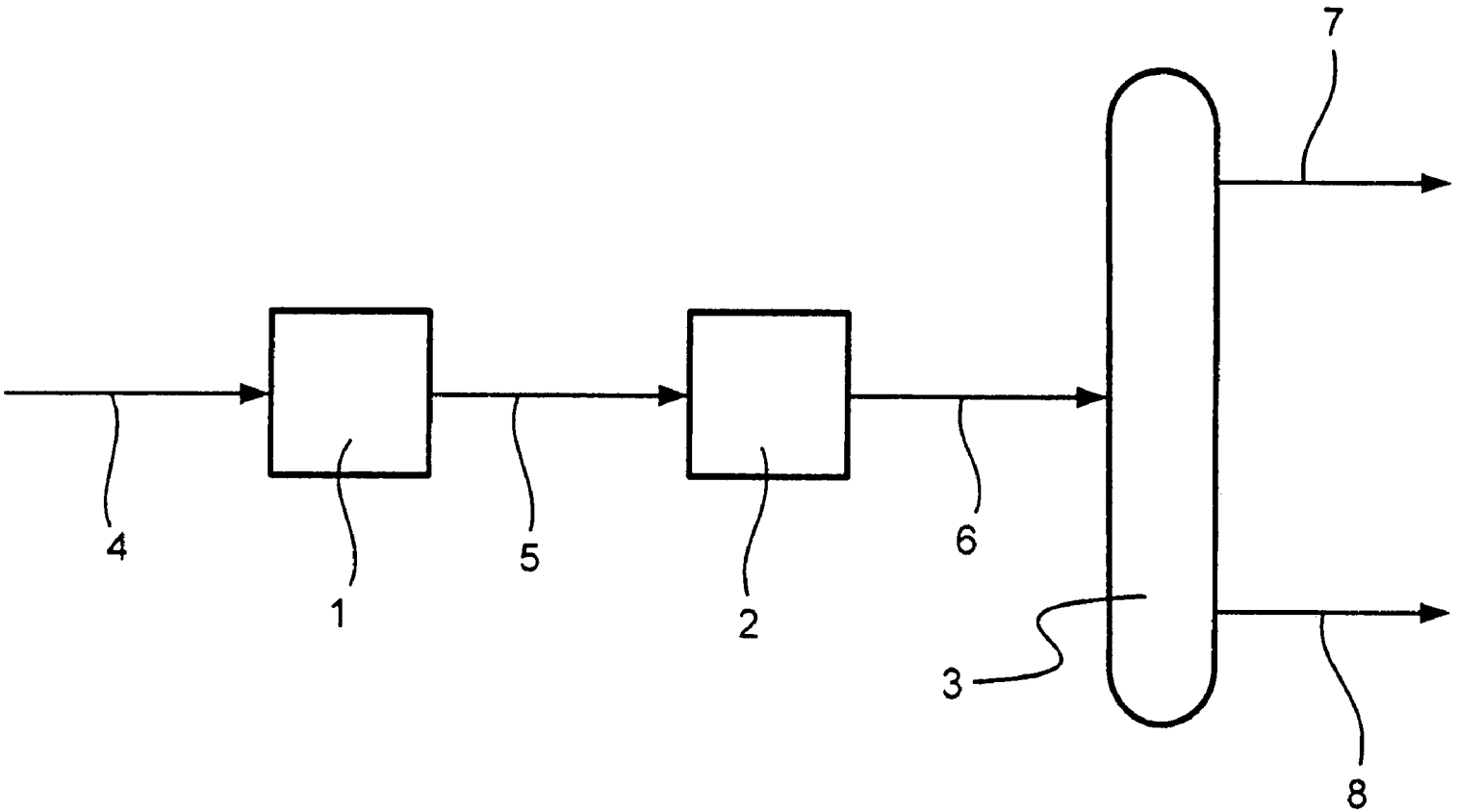

FIG. 2 shows a first reaction zone (1) a second reaction zone (2) and a fractionating unit (3). A liquid hydrocarbon feed comprising an alkylating agent and organic nitrogen and organic sulphur species is passed via line (4) to the first reaction zone (1) wherein it is contacted with an acidic catalyst and the organic nitrogen species are alkylated to form organic nitrogen species of higher boiling point.

The hydrocarbon feed stream is then passed via line (5) to a second reaction zone (2) wherein it is contacted with an acidic catalyst and the organic sulphur species are alkylated to form organic sulphur species of higher boiling point.

The liquid hydrocarbon feed is then passed via line (6) to the fractionating unit (3) wherein it is separated to provide a hydrocarbon feed stream with a lower boiling range and a decreased nitrogen and sulphur content which exits the fractionating unit (3) via line (7) and a hydrocarbon feed stream with a higher boiling range and an increased nitrogen and sulphur content which exits the fractionating unit (3) via line (8).

Figure 3:
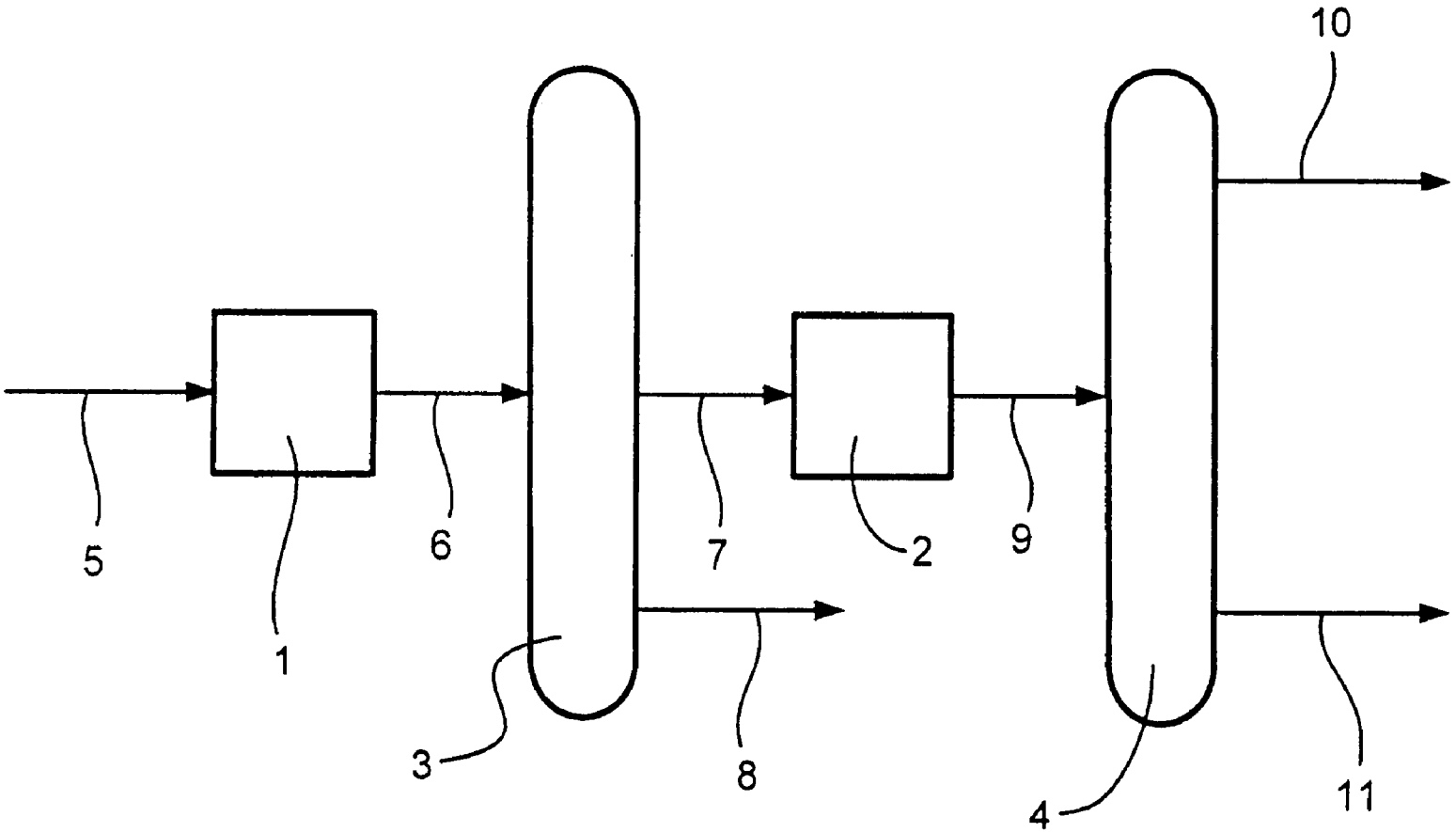

FIG. 3 shows a first reaction zone (1) a second reaction zone (2) a first fractionating unit (3) and a second fractionating unit (4). A liquid hydrocarbon feed comprising an alkylating agent and organic nitrogen and sulphur species is passed via line (5) to the first reaction zone (1) wherein it is contacted with an acidic catalyst and the organic nitrogen species are alkylated to form organic nitrogen species of higher boiling point.

The liquid hydrocarbon feed is then passed via line (6) to the first fractionating unit (3) wherein it is separated to provide a hydrocarbon feed stream with a lower boiling range and a decreased nitrogen content which exits the first fractionating unit (3) via line (7) and a hydrocarbon feed stream with a higher boiling range and an increased nitrogen content which exits the first fractionating unit (3) via line (8).

The hydrocarbon feed stream exiting the first fractionating unit (3) via line (7) is then passed to a second reaction zone (2) wherein it is contacted with an acidic catalyst and the organic sulphur species are alkylated to form organic sulphur species of higher boiling point.

The liquid hydrocarbon feed is then passed via line (9) to a second fractionating unit (4) wherein it is separated to provide a hydrocarbon feed stream with a lower boiling range and a decreased sulphur content which exits the second fractionating unit (4) via line (10) and a hydrocarbon feed stream with a higher boiling range and an increased sulphur content which exits the second fractionating unit (4) via line (11).

The invention claimed is:

1. A process for increasing the boiling point of organic nitrogen species present within a liquid hydrocarbon feed wherein said process comprises contacting a liquid hydrocarbon feed comprising an alkylating agent and organic nitrogen species, said liquid hydrocarbon feed being one or more petroleum fractions with a boiling range of 10-450° C. selected from the group consisting of catalytically cracked naphtha, coker naphtha and visbroken naphtha, with an acidic catalyst at elevated temperature in a first reaction zone to generate a liquid hydrocarbon feed comprising a reduced alkylating agent content and organic nitrogen species of higher boiling point and removing the organic nitrogen species of higher boiling point by fractionation.

2. A process for reducing the nitrogen content of a liquid hydrocarbon feed wherein said process comprises:

a) contacting a liquid hydrocarbon feed comprising an alkylating agent and organic nitrogen species, said liquid hydrocarbon feed being one or more petroleum fractions with a boiling range of 10-450° C. selected from the group consisting of catalytically cracked naphtha, coker naphtha and visbroken naphtha, with an acidic catalyst at elevated temperature in a first reaction zone to generate a liquid hydrocarbon feed comprising a reduced alkylating agent content and organic nitrogen species of higher boiling point; and b) removing the organic nitrogen species of higher boiling point by fractination to generate a liquid hydrocarbon feed comprising a reduced alkylating agent content and a reduced nitrogen content.

3. A process according to claim 2 for reducing the sulphur and nitrogen content of a liquid hydrocarbon feed wherein said process comprises:

a) contacting a liquid hydrocarbon feed comprising an alkylating agent and organic nitrogen and organic sulphur species, said liquid hydrocarbon feed being one or more petroleum fractions with a boiling range of 10-450° C. selected from the group consisting of catalytically cracked naphtha, coker naphtha and visbroken naphtha, with an acidic catalyst at elevated temperature in a first reaction zone to generate a liquid hydrocarbon feed comprising a reduced alkylating agent content, organic sulphur species and organic nitrogen species of higher boiling point;

b) contacting the liquid hydrocarbon feed comprising a reduced alkylating agent content, organic sulphur species and organic nitrogen species of higher boiling point with an acidic catalyst at elevated temperature in a second reaction zone to generate a liquid hydrocarbon feed comprising a reduced alkylating agent content, organic sulphur species of higher boiling point and organic nitrogen species of higher boiling point; and c) fractionating the liquid hydrocarbon feed comprising a reduced alkylating agent content, organic sulphur species of higher boiling point and organic nitrogen species of higher boiling point to remove the organic nitrogen species of higher boiling point and the organic sulphur species of higher boiling point to generate a liquid hydrocarbon feed comprising a reduced alkylating agent content and a reduced nitrogen and sulphur content.

4. A process according to claim 2 for reducing the sulphur and nitrogen content of a liquid hydrocarbon feed wherein said process comprises:

a) contacting a liquid hydrocarbon feed comprising an alkylating agent and organic nitrogen and sulphur species, said liquid hydrocarbon feed being one or more petroleum fractions with a boiling range of 10-450° C. selected from the group consisting of catalytically cracked naphtha, coker naphtha and visbroken naphtha, with an acidic catalyst at elevated at elevated temperature in a first reaction zone to generate a liquid hydrocarbon feed comprising a reduced alkylating agent content, organic sulphur species and organic nitrogen species of higher boiling point;

b) fractionating the liquid hydrocarbon feed comprising a reduced alkylating agent content, organic sulphur species and organic nitrogen species of higher boiling point to remove the organic nitrogen species of higher boiling point to generate a liquid hydrocarbon feed comprising a reduced alkylating agent content, organic sulphur species and a reduced nitrogen content;

c) contacting the liquid hydrocarbon feed comprising a reduced alkylating agent content, organic sulphur species and a reduced nitrogen content with an acidic catalyst at elevated temperature in a second reaction zone to generate a liquid hydrocarbon feed comprising a reduced alkylating agent content, organic sulphur species of higher boiling point and reduced nitrogen content; and d) fractionating the liquid hydrocarbon feed comprising a reduced alkylating agent content, organic sulphur species of higher boiling point and a reduced nitrogen content to remove the organic sulphur species of higher boiling point to generate a liquid hydrocarbon feed comprising a reduced alkylating agent content and a reduced nitrogen and sulphur content.

5. A process according to claim 2 wherein the liquid hydrocarbon feed is selected from the group consisting of diesel, gasoline, kerosene and jet fuel.

6. A process according to claim 2 wherein organic nitrogen species is selected from the group consisting of alkyl amines, anilines, pyroles and pryridines.

7. A process according to claim 2 wherein the liquid hydrocarbon feed comprising organic nitrogen species usually has a total nitrogen content (expressed as elemental N) of between 5-3000 ppm N.

8. A process according to claim 2 wherein the organic nitrogen species have a boiling point of between 50 and 450° C.

9. A process according to claim 3 wherein the organic sulphur species is selected from the group consisting of mercaptans, thiophenes, benzothiophene, dibenzothiophenenes and hindered alkyl substituted dibenzothiophenes.

10. A process according to claim 3 wherein the liquid hydrocarbon feed comprising an alkylating agent and organic nitrogen and sulphur species has a total sulphur content (expressed as elemental S) of 10-50000 ppm S.

11. A process according to claim 4 wherein the organic sulphur species is selected from the group consisting of mercaptans, thiophenes, benzothiophene, dibenzothiophenenes and hindered alkyl substituted dibenzothiophenes.

12. A process according to claim 4 wherein the liquid hydrocarbon feed comprising an alkylating agent and organic nitrogen and sulphur species has a total sulphur content (expressed as elemental S) of 10-5000 ppm S.

13. A process according to claim 2 wherein the acidic catalyst is a solid.

14. A process according to claim 2 wherein the first reaction zone is maintained at a temperature of between 50° C. -300° C. and at pressure of between 1-100 bar.

15. A process according to claim 3 wherein the second reaction zone is maintained at a temperature of between 100° C. -300° C. and at pressure of between 1-100 bar.

16. A process according to claim 4 wherein the second reaction zone is maintained at a temperature of between 100° C. -300° C. and at pressure of between 1-100 bar.

* * * * *